US005728434A

United States Patent [19]

Hewitt

[11] Patent Number: 5,728,434

[45] Date of Patent: Mar. 17, 1998

[54] METHOD OF APPLYING A WEAR-RESISTANT COATING ON A THIN, METALLIC STRIP-SHAPED CARRIER

[75] Inventor: Keith H. Hewitt, Sandy, Oreg.

[73] Assignee: Pacific/Hoe Saw and Knife Company, Portland, Oreg.

[21] Appl. No.: 512,938

[22] Filed: Aug. 8, 1995

[51] Int. Cl.[6] ..... B05D 1/02; B05D 1/32; B05D 1/36

[52] U.S. Cl. ..... 427/448; 427/454; 427/282; 427/284; 427/421

[58] Field of Search ..... 427/448, 454, 427/456, 282, 284, 287, 405, 419.2, 421; 118/504

[56] References Cited

U.S. PATENT DOCUMENTS

| | | | |
|---|---|---|---|
| 2,639,490 | 5/1953 | Brennan | 29/17.2 |
| 2,697,671 | 12/1954 | Brennan | 427/177 |
| 2,816,826 | 12/1957 | Brennan | 75/333 |
| 2,862,837 | 12/1958 | Brennan | 117/4 |
| 3,866,565 | 2/1975 | Ridout | 118/49.1 |
| 4,016,635 | 4/1977 | Leitermann et al. | 29/156.6 |
| 4,100,881 | 7/1978 | d'Andréa et al. | 118/319 |
| 4,106,782 | 8/1978 | Hyde et al. | 277/235 |
| 4,446,812 | 5/1984 | Wang | 118/63 |
| 4,572,099 | 2/1986 | Michel et al. | 118/68 |
| 4,588,021 | 5/1986 | Bergeron et al. | 164/432 |
| 4,600,599 | 7/1986 | Wallsten | 427/34 |
| 5,085,167 | 2/1992 | Hebels | 118/65 |
| 5,338,577 | 8/1994 | Burdette | 427/453 |
| 5,401,317 | 3/1995 | Cox et al. | 118/712 |
| 5,413,806 | 5/1995 | Braun | 427/9 |
| 5,415,717 | 5/1995 | Perneborn | 156/276 |

FOREIGN PATENT DOCUMENTS

| | | |
|---|---|---|
| 57-53274 | 3/1982 | Japan . |
| 978988 | 1/1965 | United Kingdom . |
| 1 289 609 | 9/1972 | United Kingdom . |

*Primary Examiner*—Shrive Beck
*Assistant Examiner*—Fred J. Parker
*Attorney, Agent, or Firm*—Klarquist Sparkman Campbell Leigh & Whinston, LLP

[57] ABSTRACT

A method of making coater and doctor blades for use on paper-making machinery is disclosed. A bond coating and then a wear-resistant coating are applied to one edge of an endless steel carrier strip. The strip is passed together with a masking strip continuously in only one direction through a coating zone for spraying by a plasma gun. The masking strip masks a transverse portion of the carrier strip so as to leave one edge of the latter exposed to the spray. Spraying continues for the number of passes necessary to apply desired thicknesses of the coatings to the carrier strip.

10 Claims, 1 Drawing Sheet

METHOD OF APPLYING A WEAR-RESISTANT COATING ON A THIN, METALLIC STRIP-SHAPED CARRIER

FIELD OF THE INVENTION

This invention relates to coater and doctor blades for use of paper-making machinery and, more particularly, to a method of applying a wear-resistant coating to one edge of a thin, metallic strip-shaped carrier blade, whereby the coating prolongs the effective life of the blade and prevents scoring or scratching of the roll surface being doctored and/or reduces wear on the coater blade from paper coating compounds.

BACKGROUND OF THE INVENTION

Coater and doctor blades are commonly made of steel. When coated with a ceramic coating, such as aluminum oxide, a blade will wear many times longer than one with a plain steel edge, while at the same time, better protecting the roll surface from scoring or scratching and preventing premature wear-out of the coater blade. Blades as aforesaid are disclosed in United Kingdom Patents Nos. 978,988, published Jan. 1, 1965, and 1,289,609, published Sep. 20, 1972.

A method of applying such a wear-resistant coating to a steel blade or strip is disclosed in Wallstén, U.S. Pat. No. 4,660,599 (the '599 patent). This patent discloses a method of applying a wear-resistant coating to a thin steel strip, wherein the strip is fed from one reel, through a coating zone, to another reel, whereafter the apparatus is reversed, such that the strip passes back and forth through the coating zone for successive applications until a desired thickness of coating is achieved. Reversing any apparatus, of course, requires starting and stopping the apparatus, which is disadvantageous.

Furthermore, inasmuch as the coating is applied only along one edge of the strip, a strip-shaped is required to fill out the transversely uncoated part of the strip, the interlayer being inserted after each complete winding of the strip onto a reel and prior to commencing the next pass. Otherwise, the coated edge of the strip would become thicker with the application of successive coatings, which would result in instability as the strip is wound on a reel.

Companies practicing the process of the '599 patent have utilized a masking strip to shield a transverse portion of the steel strip from the coating-spraying unit, such that the coating is applied only to the unshielded edge of the carrier strip. The masking strip, however, also must be transferred from one reel to the other as the apparatus is reversed.

Furthermore, winding a steel strip on a reel results in the beginning and end of the strip being lost to production due to the necessity of attaching the strip to the reel at each of its ends.

It is thus the primary object of the present invention to provide a method of applying a wear-resistant coating to one edge of a thin, metallic strip-shaped carrier wherein the passing of strip material forwardly and backwardly alternately between a pair of reels is eliminated.

A further object of the invention is to provide a method as aforesaid, wherein the necessity to insert a strip-shaped interlayer between each turn of the steel strip is also rendered unnecessary.

A still further object of the invention is to provide a method as aforesaid, wherein the amount of strip material lost during the process is minimized.

SUMMARY OF THE INVENTION

The method of the invention applies a wear-resistant coating to one edge of a thin, metallic strip-shaped carrier. A coating apparatus is provided having a spraying unit adapted to spray a molten coating agent in a restricted coating zone. The coating agent, when hardened, has the property of becoming wear-resistant to a greater degree than the carrier itself. An endless, thin, metallic strip-shaped carrier is passed continuously through the coating zone, in one direction only, without any reversing of the apparatus, whereby the carrier is sprayed in the zone by the spraying unit until a desired thickness of coating material is achieved along the entire strip-shaped carrier.

A masking strip is also passed continuously in the one direction through the coating zone between the spraying unit and the strip-shaped carrier. The masking strip contacts the carrier at least in the coating zone. The masking strip masks a transverse portion of the strip-shaped carrier within the zone such as to leave only one edge of the carrier exposed to the spraying unit. In this manner, the spraying unit sprays the coating agent only on the one exposed edge of the carrier in the coating zone, the masked portion of the carrier within the zone being protected from spraying by the masking strip.

The coating agent is sprayed on the one exposed edge of the carrier within the coating zone as the carrier passes through the zone. The method is continued until a desired thickness of wear-resistant coating is applied to the one exposed edge of the entire carrier.

Preferably, the method utilizes an endless strip-shaped carrier comprising a steel strip made continuous by having its ends welded together. The carrier is passed around a plurality of spaced rollers, at least one of which is adapted to apply tension to the carrier. The masking strip is also passed around a plurality of spaced rollers, at least one of which is also adapted to apply tension to the masking strip.

Finally, the method preferably comprises providing a plurality of support rollers adapted to support each of the strip-shaped carrier and the masking strip at least within the coating zone, thereby to facilitate contact of the carrier with the strip in the zone.

DESCRIPTION OF THE PREFERRED EMBODIMENT

Figure 1:
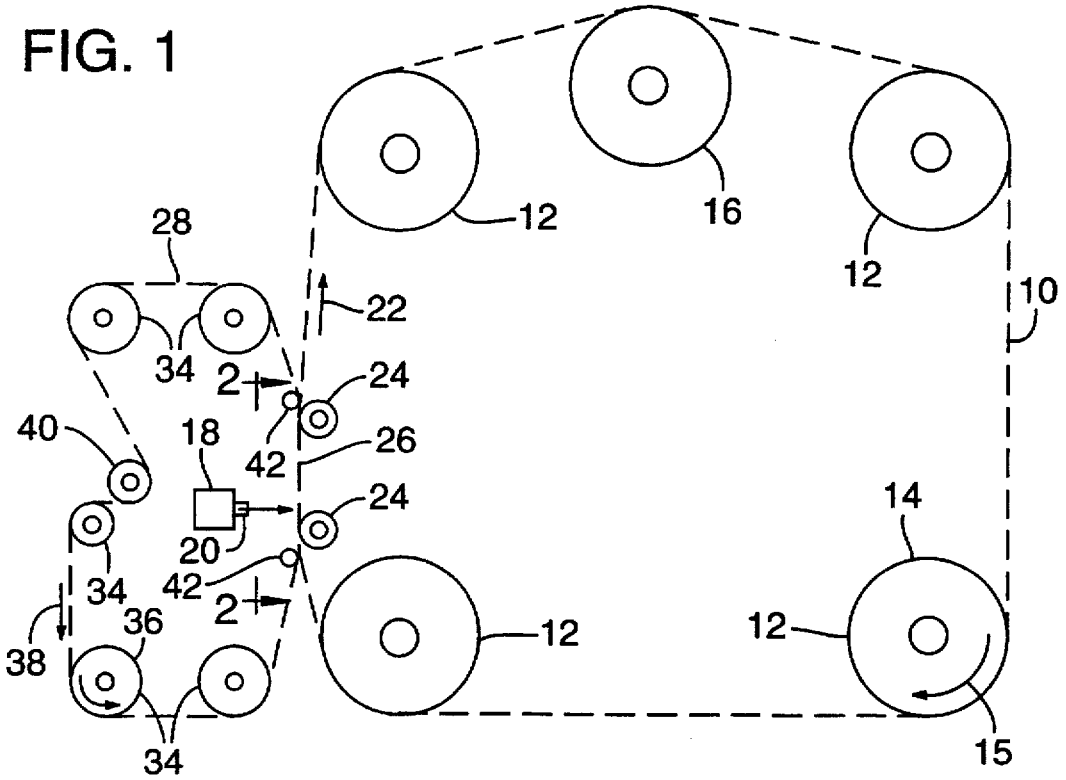
FIG. 1 is a diagrammatic side view of apparatus suitable for practicing the method of the invention.

Referring to the drawings, FIG. 1 illustrates an apparatus for applying a wear-resistant coating to a strip-shaped carrier 10. If the equipment is to be used to manufacture flexible steel blades to coat paper, i.e., coater blades, carrier 10 is preferably a steel strip of 1095 grade blue steel, whose width ranges from about 2½ inches to about 4½ inches and whose thickness ranges from about 0.006 inch to 0.035 inch. Steel strip of this description is supplied by Uddeholm Strip Steel AB, Munkfors, Sweden, and by J. N. Eberle & Cie. GmbH, Augsburg, Germany. A length of steel strip of between 160 and 430 feet is initially selected, and the ends are welded together to form an endless loop.

Steel strip 10 is then passed around four spaced rollers 12, one of which rollers constitutes a drive wheel 14 which drives the strip 10 continuously only in the direction of arrow 15. A fifth roller, constituting a tension wheel 16, applies a radially directed force to strip 10 to produce approximately 50 pounds tension in the strip.

Strip 10 is driven vertically upwardly past a ceramic spray (plasma) gun 18. Plasma gun 18 includes a nozzle 20 and is positioned such that it can spray molten coating material along one edge of strip 10 as the strip is passed in the direction of arrow 22 in front of nozzle 20. A pair of guide rollers 24 mounted on support frames 25 support strip 10 and, in effect, define a longitudinally restricted coating zone 26. Nozzle 20 is desirably spaced approximately four inches from the surface of strip 10. A suitable plasma gun is manufactured by Miller Thermal, Inc., Appleton, Wis., Model No. SG 100, having an orifice size of 0.312 inch, which provides a spray cone having a diameter (where it impacts strip 10) of about one inch.

Figure 2:
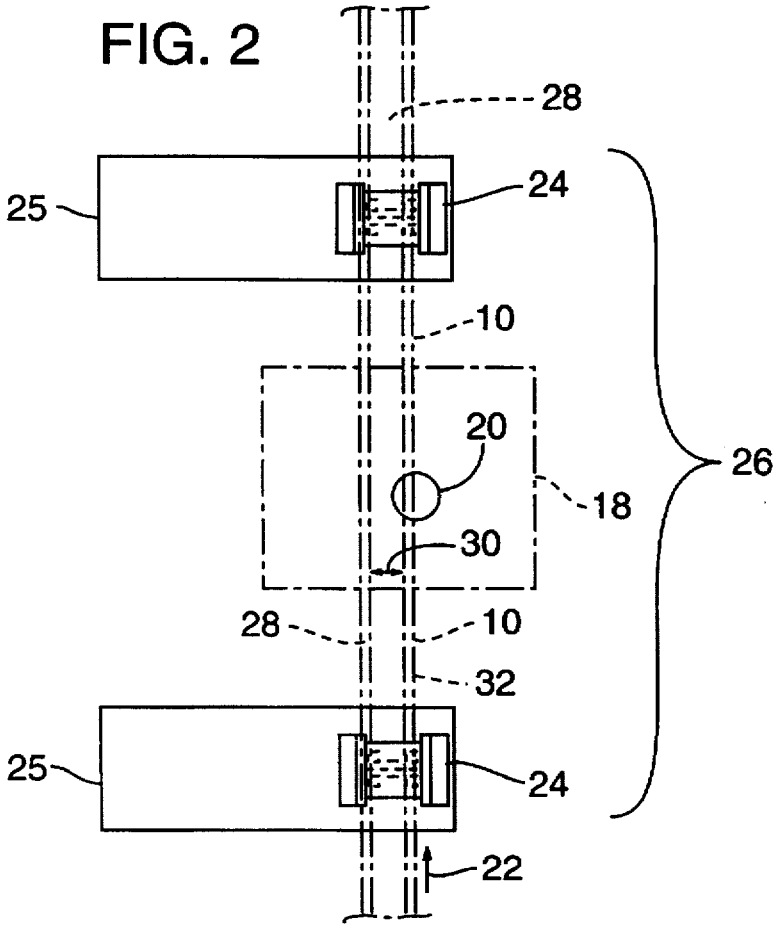
FIG. 2 is a sectional view taken on line 2—2 of FIG. 1.

A masking strip 28 is also passed in front of nozzle 20, between plasma gun 18 and strip 10, contacting strip 10 within coating zone 26, and masking a transverse portion 30 of strip 10 within zone 26, such as to leave only an edge 32 exposed to the area of spray. See FIG. 2.

Masking strip 28 is placed such that a coating approximately ⅛ inch wide is deposited on edge 32 of strip 10. Masking strip 28 effectively prevents portion 30 from being sprayed. Masking strip 28 may also comprise an endless steel strip, whose ends are welded together, made of the same composition steel as the strip used for the carrier itself. The width of masking strip 28 may vary, although of course it must be at least ⅜ inch narrower than strip 10 in order to achieve the desired ⅜ inch wide coating. A 0.015 inch thick steel strip 28 has been found satisfactory for use in the method.

Masking strip 28 is passed around five rollers 34, one of which constitutes a drive wheel 36, which drives strip 28 continuously only in the direction of arrow 38 such that strip 28 and carrier 10 travel vertically upwardly together through coating zone 26. A tension wheel 40 applies a transverse force to strip 28 so as to achieve approximately the same tension as is applied to strip 10. A pair of guide rollers 42 support strip 28 and facilitate contact with strip 10 in coating zone 26. Strip 10 and masking strip 28 are driven past plasma gun 18 through coating zone 26 desirably at a speed of approximately 150 feet/minute.

Although strips 10 and 28 are described and illustrated as traveling vertically upwardly through coating zone 26, if desired the apparatus could be arranged such that the two strips travel vertically downwardly through the zone, or the apparatus could be arranged such that the strips travel in a horizontal plane.

Plasma gun 18 is first provided with powder to spray a molten bond coat on edge 32 of carrier 10. The bond coat is desirably a nickel chrome alloy, 80 Ni 20 Cr, particle fraction −30 +5 μm, supplied by Alloys International through Miller Thermal, Inc., Appleton, Wis. Approximately 0.0005 inch of material is deposited by nozzle 22 with each pass of strip 10. A desirable thickness of bond coat is 0.003 inch, thus requiring six passes.

Gun 18 is then provided with powder to spray a ceramic coat in molten form on edge 32. The ceramic coat desirably comprises ninety-seven (97%) aluminum oxide ($Al_2O_3$) and three (3%) percent titanium oxide ($TiO_2$), particle fraction −30 +5 μm, also supplied by Alloys International through Miller Thermal, Inc., Appleton, Wis. Approximately 0.0005 inch of this material is also deposited by nozzle 22 with each pass of strip 10. A desirable thickness of ceramic coat is 0.020 inch, thus requiring forty passes. The total coating (bond plus ceramic) is, accordingly, 0.023 inch.

The coating applied during any one pass is allowed to cool as the longitudinal coated portion of strip 10 passes around rollers 12 on its way back to zone 26 for spraying during the next pass.

After the total thickness of coating material has been applied and the coating has hardened sufficiently, strip 10 is ground in coil form with a diamond wheel to obtain a final surface finish of maximum roughness 30μ inch. A desirable grinding speed is five meters/minute. Strip 10 is then cut to the desired final blade length.

It is important to note that all of the above-mentioned specific coatings, speeds, tensions and other technical data have alternatives, variations and options which can achieve a similar satisfactory result. Thus the above description is intended to be only illustrative and exemplary, and the invention is not to be limited except as set forth in the following claims.

I claim:

1. A method of applying a wear-resistant coating to one edge of a thin metallic strip-shaped carrier, comprising:

providing a coating apparatus including a spraying unit having a nozzle for emitting a spray of a molten coating agent in a coating zone, the coating agent, when hardened, forming a wear-resistant coating having greater wear-resistance than the thin metallic strip-shaped carrier itself;

forming a length of the thin metallic strip-shaped carrier into a closed endless loop to form a carrier strip loop and passing the carrier strip loop continuously in only one direction through the coating zone with the outside of the carrier strip loop facing the nozzle;

forming a length of a masking strip into a closed endless loop to form a masking strip loop and passing the masking strip loop continuously in the one direction through the coating zone, the outside of the masking strip loop contacting the outside of the carrier strip loop in the coating zone, the masking strip loop passing between the nozzle and the carrier strip loop, the masking strip loop having a width less than the width of the carrier strip loop wherein the masking strip loop masks a transverse portion of the carrier strip loop within the coating zone to leave one edge of the outside of the carrier strip loop exposed to the nozzle of the spraying unit, wherein the nozzle of the spraying unit sprays the coating agent on the one exposed edge of the outside of the carrier strip loop, the masking strip loop protecting the masked portion of the outside of the carrier strip loop from spraying;

spraying molten coating agent continuously on the one exposed edge of the outside of the carrier strip loop as the carrier strip loop and the masking strip loop pass through the coating zone until a desired thickness of wear-resistant coating is applied to the one exposed edge of the outside of the carrier strip loop; and cutting the carrier strip loop into desired lengths of edge coated metallic strip-shaped carrier.

2. The method of claim 1, further comprising:

first spraying a bond coating continuously on the one exposed edge of the outside of the carrier strip loop until a desired thickness of bond coating is applied; and then spraying the wear-resistant coating agent continuously on the one exposed bond-coated edge of the outside of the carrier strip loop until a desired thickness of wear-resistant coating is applied over the bond coating.

3. The method of claim 2, wherein the inside of the carrier strip loop is supported by a plurality of spaced rollers which contact the inside of the carrier strip loop, one of the rollers applying tension to the carrier strip loop.

4. The method of claim 3, wherein the inside of the masking strip loop is supported by a plurality of spaced rollers which contact the inside of the masking strip loop, one of the rollers applying tension to the masking strip loop.

5. The method of claim 4, further comprising providing a plurality of support rollers to support the insides of each of the carrier strip and masking strip loops within the coating zone to facilitate contact of the carrier strip loop with the masking strip loop in the coating zone.

6. The method of claim 1, wherein the forming of the carrier strip loop comprises welding together the ends of a length of metallic strip-shaped carrier.

7. The method of claim 6, wherein the forming of the masking strip loop comprises welding together the ends of a steel strip.

8. The method of claim 7, wherein the carrier strip loop and the masking strip loop each comprises a steel strip having the same composition.

9. A method of applying a coating to one edge of a thin metallic strip-shaped carrier, comprising:

forming a length of a metallic strip-shaped carrier and a length of a masking strip into two endless loops;

positioning the carrier strip loop and the masking strip loop such that their outside surfaces contact each other in a coating zone, the width of the masking strip loop being less than the width of the carrier strip loop, the two loops being positioned so that the outside of the masking strip loop masks a transverse portion of the outside of the carrier strip loop to leave one edge of the carrier strip loop exposed within the coating zone;

passing the carrier strip loop and the masking strip loop continuously in only one direction through the coating zone;

spraying a molten coating agent on the one exposed edge of the outside of the carrier strip loop as the carrier strip loop and the masking strip loop portion pass through the coating zone;

cooling the one exposed edge of the carrier strip loop after it leaves the coating zone;

continuing the spraying until a desired thickness of coating agent has been applied to the one exposed edge of the outside of the carrier strip loop; and cutting the edge coated carrier strip loop into desired lengths of edge coated metallic strip-shaped carrier.

10. The method of claim 9, further comprising supporting the inside of each of the carrier strip loop and the masking strip loop by a plurality of spaced rollers, one of which rollers applies tension to each of the carrier strip and masking strip loops.

* * * * *

UNITED STATES PATENT AND TRADEMARK OFFICE

CERTIFICATE OF CORRECTION

PATENT NO. : 5,728,434

DATED : March 17, 1998

INVENTOR(S) : Keith H. Hewitt

It is certified that error appears in the above-identified patent and that said Letters Patent is hereby corrected as shown below:

Column 4, Line 62, "3. The method of claim 2" should be --3. The method of claim 1--.

Signed and Sealed this

Tenth Day of November 1998

Bruce Lehman

*Attest:*

BRUCE LEHMAN

*Attesting Officer*

*Commissioner of Patents and Trademarks*